US006874937B2

(12) United States Patent
Ausnit

(10) Patent No.: US 6,874,937 B2
(45) Date of Patent: Apr. 5, 2005

(54) RECLOSABLE PACKAGING HAVING SLIDER-OPERATED ZIPPER WITH TAMPER-EVIDENT MEMBRANE

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 97 days.

(21) Appl. No.: 10/023,134

(22) Filed: Dec. 18, 2001

(65) Prior Publication Data

US 2003/0113041 A1 Jun. 19, 2003

(51) Int. Cl.[7] ..... B65D 33/16
(52) U.S. Cl. ..... 383/64; 382/61.2; 382/61.3
(58) Field of Search ..... 383/64, 61.2, 61.3, 383/63, 5, 59, 203; 24/400, 585.12, DIG. 39, DIG. 40, DIG. 50

(56) References Cited

U.S. PATENT DOCUMENTS

| | | | | |
|---|---|---|---|---|
| 2,772,712 A | * | 12/1956 | Post | 383/65 |
| 3,440,696 A | | 4/1969 | Staller | |
| 3,746,215 A | | 7/1973 | Ausnit et al. | |
| 3,991,801 A | | 11/1976 | Ausnit | |
| 4,191,230 A | | 3/1980 | Ausnit | |
| 4,290,467 A | | 9/1981 | Schmidt | |
| 4,691,373 A | | 9/1987 | Ausnit | |
| 4,703,518 A | * | 10/1987 | Ausnit | 383/63 |
| 4,892,414 A | | 1/1990 | Ausnit | |
| 4,896,775 A | * | 1/1990 | Boeckmann et al. | 206/557 |
| 4,949,527 A | * | 8/1990 | Boeckmann et al. | 53/412 |
| 6,047,450 A | | 4/2000 | Machacek et al. | |
| 6,273,607 B1 | * | 8/2001 | Buchman | 383/5 |
| 2002/0154837 A1 | * | 10/2002 | Ausnit | 383/64 |

FOREIGN PATENT DOCUMENTS

| | | |
|---|---|---|
| FR | 2777498 | * 10/1999 |
| FR | 2777499 | * 10/1999 |

* cited by examiner

*Primary Examiner*—Joseph C. Merek
(74) *Attorney, Agent, or Firm*—Ostrager Chong Flaherty & Broitman P.C.

(57) ABSTRACT

A reclosable package or bag having a mouth with a plastic zipper installed therein. In one embodiment, the zipper has first and second interlockable profiled structures connected by a membrane. The membrane acts as a tamper-evident feature and a hermetic seal. The plastic zipper is opened and closed by a slider that has no separating finger to separate the interlocked profiles. The membrane can be configured and situated such that it is captured in an interstice formed by the interlocked profiled structures and also serves as a liquid-tight seal after the membrane is torn. In another embodiment, the membrane depends from one of the profiled structures of the zipper. The membrane has a width and gauge that allow it to serve as a liquid-tight sealing gasket when captured in the interstice formed by the interlocked profiled structures.

5 Claims, 5 Drawing Sheets

RECLOSABLE PACKAGING HAVING SLIDER-OPERATED ZIPPER WITH TAMPER-EVIDENT MEMBRANE

FIELD OF THE INVENTION

The present invention relates to bags or packages such as may be formed from plastic film and having an openable and reclosable mouth. The mouth is opened and reclosed by operation of a slider mounted to an extruded plastic zipper installed in the mouth. The zipper has complementary profiles that are interlocked when the zipper is closed and can be separated to open the zipper. Bags or packages of this kind are well known and in widespread use, especially in the packaging of perishable goods such as foodstuff.

BACKGROUND OF THE INVENTION

Conventional slider-zipper assemblies typically comprise a plastic zipper having two interlocking profiles and a slider for opening and closing the zipper. In one type of slider-zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

Another type of slider-zipper assembly avoids the use of a separating finger. For example, U.S. Pat. No. 6,047,450 discloses a zipper comprising a pair of mutually interlockable profiled structures. The first profiled structure comprises an interlocking member on a surface directed toward the second profiled structure and an integral base directed away from the second profiled structure. Likewise, the second profiled structure comprises an interlocking member on a surface directed toward the first profiled structure and an integral base directed away from the first profiled structure. Additionally, portions of the two profiled structures form a fulcrum about which the profiled structures may be pivoted out of engagement when lower edges of the bases are forced towards each other. As oriented on a bag having the zipper at the top, the slider has a top from which two arms depend. The slider straddles the zipper and has a closing end and an opening end. The opening end is narrower than the closing end. Additionally, the slider does not have a separating finger. Rather, the zipper is opened by pivoting the interlocked profiled structures out of engagement about the fulcrum. The slider arms are shaped at the opening end to achieve this action by forcing the lower edges of the bases towards each other.

It is known to use slider-operated zippers in reclosable packaging for perishable foodstuffs. It is desirable that such packaging be provided with means for preventing the inadvertent or unwelcome opening of the package or bag while inside a store. While a slider facilitates a consumer opening and reclosing the package and hence is desirable in some instances, the slider makes it difficult for the manufacturer to employ conventional techniques to render the package tamper evident. There is a need for a tamper-evident seal designed to reveal when a reclosable package or bag with slider-operated zipper has been opened prior to purchase.

SUMMARY OF THE INVENTION

The present invention is directed to reclosable packaging having a slider/zipper assembly wherein the slider does not have a separating finger and the zipper comprises a pair of interlockable profiled structures connected by a tamper-evident membrane. The membrane must be torn in order to gain access to the contents of the package through the mouth of the receptacle. This feature provides evidence when a package has been tampered with. The invention is also directed to a slider/zipper assembly having the aforementioned features.

In accordance with one preferred embodiment of the invention, the tamper-evident membrane is a thin pliable web of plastic material connected at opposing edges to the respective profiled structures of the zipper and suspended therebetween when the zipper is open. When the zipper is closed, the membrane is folded and trapped in the interstice formed between the interlocked profiled structures. The side edges of the membrane are blended into the side seals of the package, so that the intact membrane hermetically seals the receptacle. After the membrane has been torn open, the separated remnants of the membrane will form a liquid-tight seal when captured in the interstice between the profiled structures.

In accordance with another preferred embodiment, one edge of the membrane is connected to one profiled structure on the consumer side of the zipper and the other edge of the membrane is connected to the other profiled structure on the product side of the zipper, so that the trapped membrane is not folded. Again the membrane forms a tamper-evident hermetic seal in the unopened package. When the seal is broken, the depending remnant of the torn membrane will again form a liquid-tight seal when captured in the interstice between the profiled structures.

In each of the above cases, a step that must be taken before the initial opening of the package results in a physical altering of the sealed package that may readily be observed or discovered by a consumer.

In accordance with a third preferred embodiment, a membrane is connected to and depends from only one of the two interlockable profiled structures of the zipper. This membrane has sufficient width that it is captured in the interstice when the profiled structures are interlocked. The membrane has a gauge sufficiently thin that it acts as a liquid-tight gasket when captured in the interstice of the closed zipper.

The invention is further directed to a slider/zipper assembly comprising a plastic zipper and a slider mounted to the zipper. The zipper comprises a pair of interlockable profiled structures that form an interstice when interlocked, and a membrane connected to at least one of the interlockable profiled structures. In accordance with some preferred embodiments, at least a portion of the membrane has a pliability and a thin gauge that allow the membrane portion to fit in and conform its profile to the interstice formed when the interlockable profiled structures are interlocked.

The membrane disclosed herein has particular application in fastener constructions that feature sliders without separating fingers. A slider with a separating finger would get entangled with the membrane.

Other features and advantages of the invention will be readily apparent from the following description of certain preferred embodiments thereof, taken in conjunction with the accompanying drawings, although variations and modifications may be effected without departing from the spirit and scope of the novel concepts of the disclosure.

DETAILED DESCRIPTION OF THE PREFERRED EMBODIMENTS

The preferred embodiment of the invention comprises a plastic zipper and a slider that lacks a separating finger. The zipper comprises a pair of mutually interlockable profiled structures and a membrane joined to the tops of the profiled structures. The membrane is designed to fit in the interstice between the profiled structures when the latter are interlocked. Conventional slider-operated plastic zippers with a separating finger cannot be re-designed to add the aforementioned membrane. In what follows, a typical slider-operated zipper of the type wherein the slider lacks a separating finger, will be described with reference to FIGS. 1–4. Then the preferred embodiments of the invention, with the membrane included, will be described with reference to FIGS. 5–8.

Figure 1:
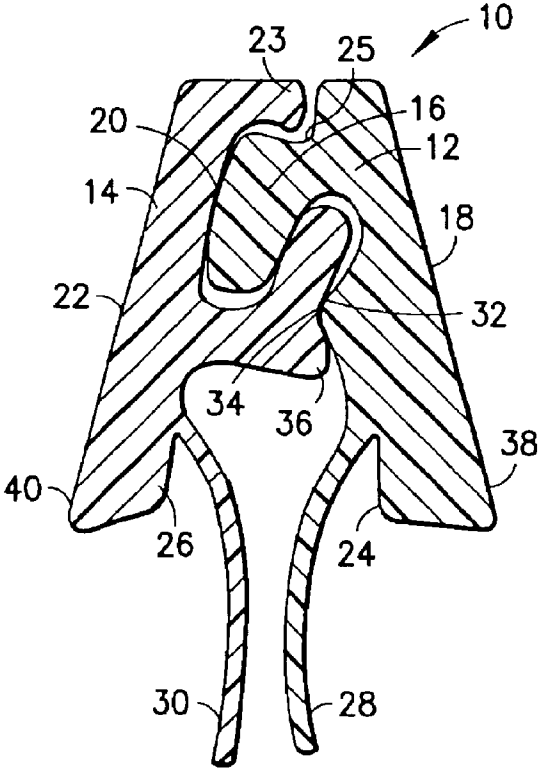
FIG. 1 is a cross-sectional view of an interlocked zipper of a known slider-operated plastic zipper having no separating finger.
Figure 4:
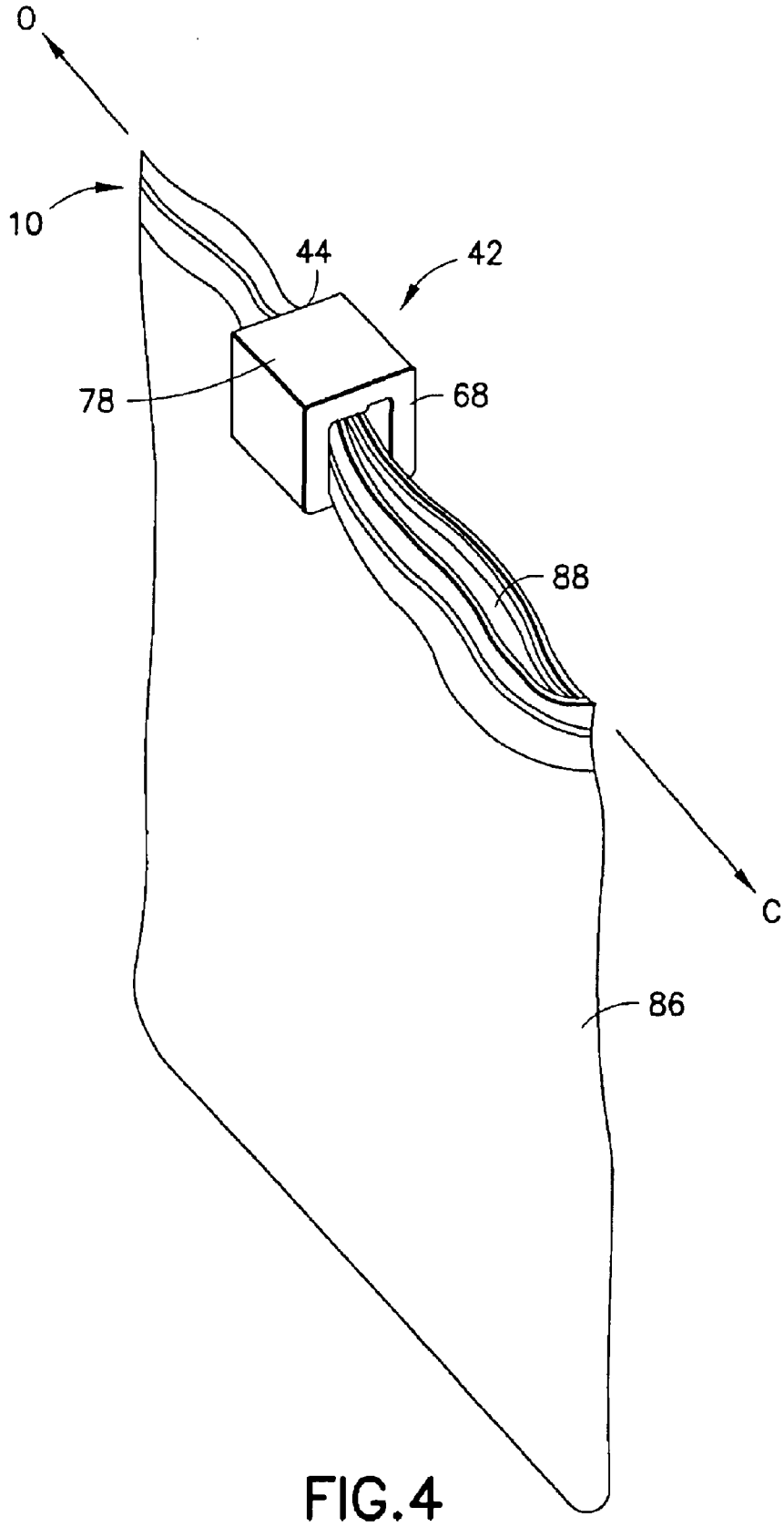
FIG. 4 is a perspective view of the slider-zipper assembly shown in FIGS. 2 and 3, installed inside the mouth of a plastic bag.

FIG. 1 shows a cross-sectional view of a known plastic zipper 10. The zipper 10 is preferably formed of a resilient plastic material, such as polyethylene, and comprises a first profiled structure 12 and a second profiled structure 14. The zipper 10 is disposable inside and across the mouth 88 of a plastic receptacle 86, as shown in FIG. 4. For purposes of this description, the receptacle 86 will be assumed to be oriented with its mouth 88 on top as depicted in FIG. 4.

The first profiled structure 12 comprises a male member 16 designed to interlock with the second profiled structure 14 and a relatively stiff base 18. Similarly, the second profiled structure 14 comprises a female member 20 designed to interlock with the male member 16 of the first profiled structure 12 and a relatively stiff base 22.

As is clear from FIG. 1, the outer surface of the bases 18 and 22 are not parallel, but diverge downwardly to form a shape that resembles the letter "A". Because of this "A" configuration, the zipper is difficult to open from the contents (i.e., product) side of the receptacle 86 (see FIG. 4) since the opening force tends to push the lower extremities of the profiled structures apart, thereby enhancing the interlock between the male member 16 and the female member 20. The zipper 10 is sealable to the receptacle 86 at base extensions or flanges 28 and 30.

The male profiled structure 12 also includes a convex fulcrum member 32 which engages a concave fulcrum member 34 of the female profiled structure 14 to form a fulcrum 36, as shown in FIG. 1. The fulcrum 36 is not equidistant between the bases 18 and 22, but rather is offset closer to the profiled structure 12. The surfaces of the fulcrum members 32 and 34 are contoured to form a seal between the interlocked profiled structures 12 and 14 at the fulcrum 36.

Figure 3:
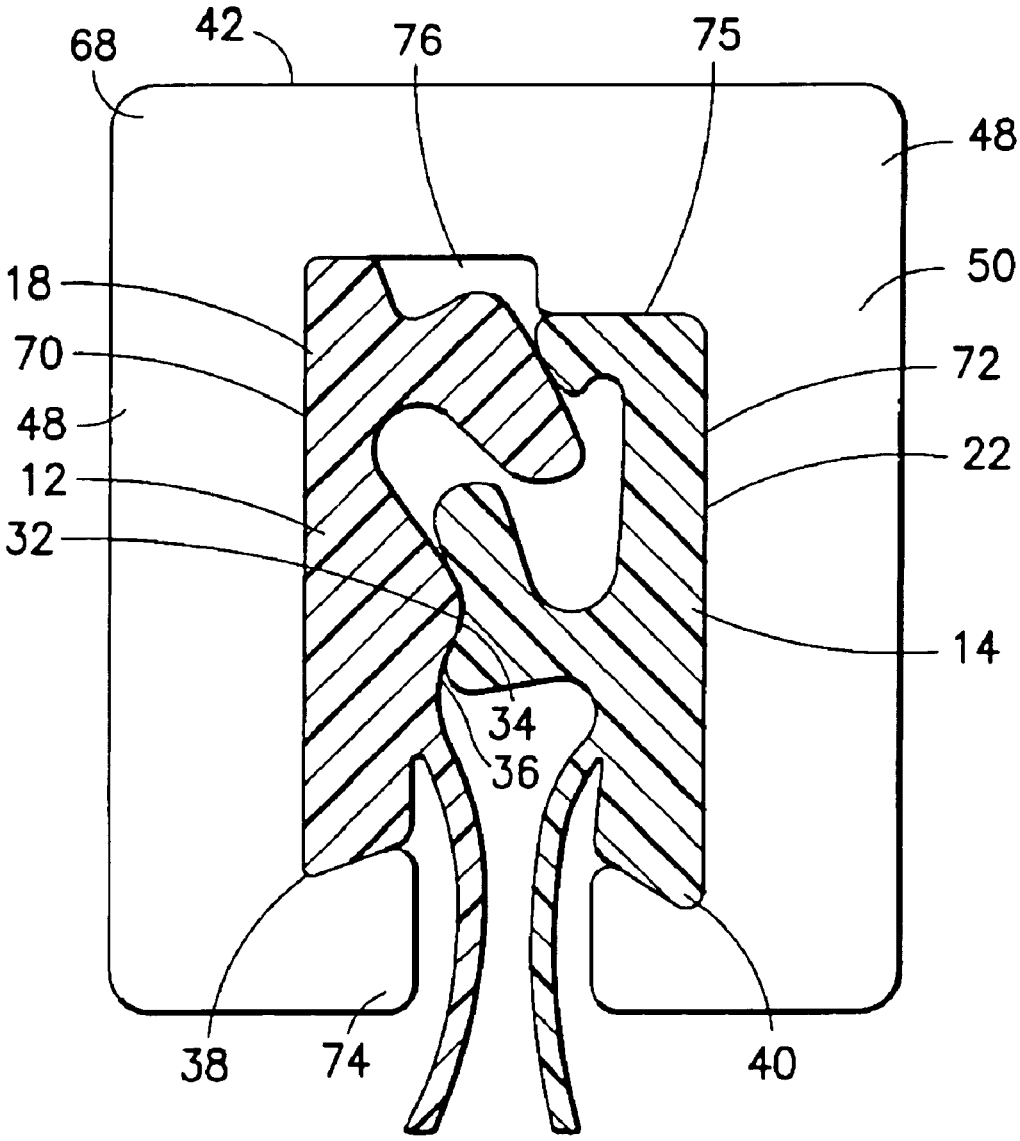
FIG. 3 is a view of the opening end of the slider-zipper assembly shown in FIG. 2, with the zipper again shown in section. The view of FIG. 3 is taken from the side opposite to that seen in FIG. 2.

When the distal edges 38 and 40 of the bases 18 and 22, respectively, are forced towards each other, the resulting leverage causes the profiled structures 12 and 14 to pivot oppositely about the fulcrum 36 and disengage from each other, as shown in FIG. 3. The male member 16 is shaped to readily permit easy disengagement from the female member 20. A top latch 23 on the female member 20 is resiliently releasable from the top cavity or indent 25 in the male member 16 to permit opening upon a force being applied to the latch 23 by an upper shoulder 75 (see FIG. 3) on an associated slider, as will be described in greater detail below. To ensure proper pivoting of the profiled structures 12 and 14, the bases 18 and 22 should be more rigid than the male and female members 16 and 20. This may be achieved, for example, by making the bases 18 and 22 thicker than the resilient portions of members 16 and 20.

Figure 2:
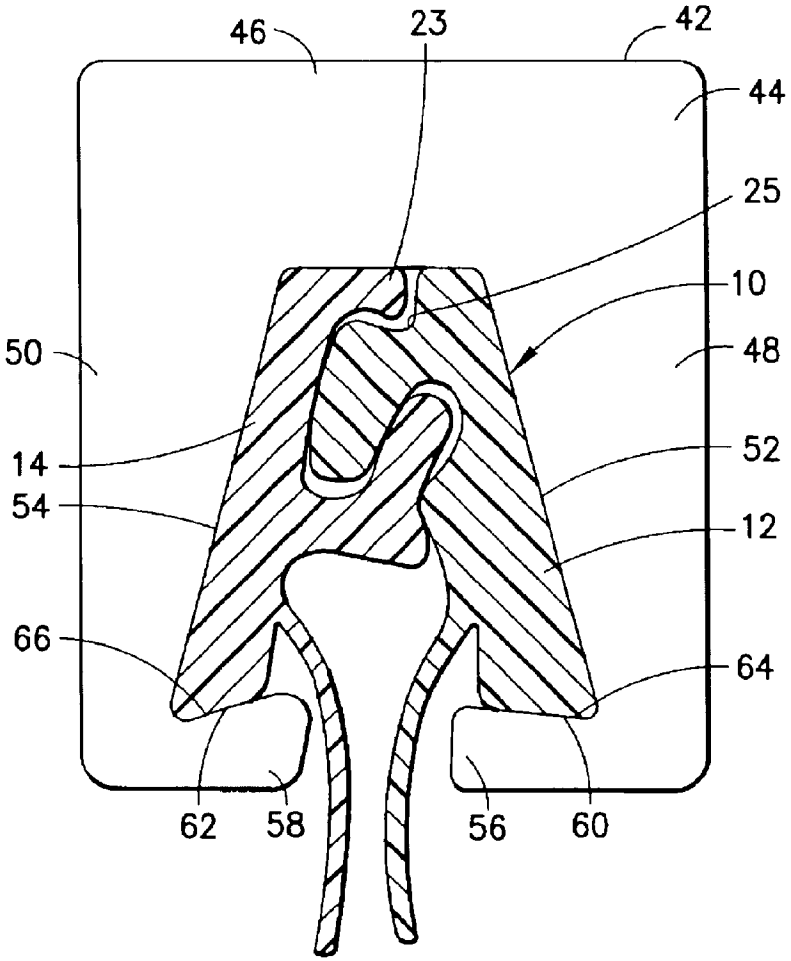
FIG. 2 is the same view as presented in FIG. 1, except that a slider has been mounted to the interlocked zipper.

To facilitate opening and closing of the zipper 10, the zipper 10 is provided with a straddling slider 42, as shown in FIG. 2. The slider 42 can be top-loaded onto the zipper without having to disengage the profiled structures at the loading point since the slider does not make use of a separating finger. As shown in FIG. 4, the slider is slidable along the zipper in a closing direction, indicated by the arrow labeled "C". The profiled structures 12 and 14 are engaged, i.e., interlocked, with each other as the slider travels in the closing direction. Similarly, the slider is slidable along the zipper in an opening direction, indicated by the arrow labeled "O". The profiled structures 12 and 14 are disengaged from each other as the slider travels in the opening direction. The slider 42 is preferably made of a resilient plastic material, such as delrin, polypropylene, PBT, etc.

FIG. 2 depicts a closing end 44 of the slider 42, with the zipper 10 shown in cross section. The closing end is shaped to force the profiled structures 12 and 14 into engagement when the slider 42 travels in the closing direction. During slider travel in the closing direction, the closing end is the trailing end of the slider. As shown in FIG. 2, the slider 42 straddles the zipper 10 and has a top 46 from which a first arm 48 and a second arm 50 depend. The first arm 48 has an inner surface 52 and the second arm 50 has an inner surface 54. The slider inner surfaces 52 and 54 are divergent with respect to each other in the same manner as the zipper bases 18 and 22, and are spaced to push the profiled structures 12 and 14 into engagement as the slider 42 is moved along the zipper 10 in the closing direction. The slider arms 48 and 50 are respectively provided with retaining shoulders 56 and 58 having upper surfaces 60 and 62 which mate with lower surfaces 64 and 66 of the profiled structures 12 and 14. The surfaces 60, 62, 64, and 66 may be tapered to maximize their pull-off resistance.

Opening of the zipper 10 is achieved when the slider 42 is moved in the opening direction. As shown in FIG. 3 (which views the slider from the side opposite to that seen in FIG. 2), at the opening end 68 of the slider, the slider arms have inner surfaces 70 and 72 which are substantially parallel, rather than divergent as at the closing end 44 (shown in FIG. 2). Additionally, the first slider arm 48 has a retaining shoulder 74 (as shown in FIG. 3) which is thicker than the first slider arm retaining shoulder 56 at the closing end 44 (as shown in FIG. 2), and a shoulder 75 extending downwardly from the zipper top portion. The overall thickness of the slider top portion 46, measured to include shoulder 75 at the opening end (as shown in FIG. 3), is thicker than the corresponding top portion 46 measured at the closing end (as shown in FIG. 2).

As the slider is moved in the opening direction and the slider arm inner surfaces change from the "A" configuration of surfaces 52 and 54 (see FIG. 2) to the substantially parallel configuration of surfaces 70 and 72 (see FIG. 3), the distal edges 38 and 40 of the profile bases 18 and 22 are forced towards each other, thereby forcing the fulcrum members into a tighter relationship and causing the profiled structures 12 and 14 to pivot oppositely about the fulcrum 36. Simultaneously, the retaining shoulder 74 on the first slider arm forces the male profile upwardly, while shoulder 75 forces the female profile downwardly causing the convex male fulcrum member 32 to cam upwardly along the concave female fulcrum member 34. Thus, as is shown in FIG. 3, the resulting action is a simultaneous pivoting of the profiled structure 12 and 14 oppositely about the fulcrum 36 and an upward translation of the first profiled structure 12 relative to the second profiled structure 14, resulting in disengagement of the profiled structures, as shown in FIG. 3. A cavity 76 in the slider top accommodates the upward translation of the male profiled structure 12.

The preferred embodiments of the present invention can be incorporated in a package or bag having a slider-operated zipper of the type described above or any other slider-operated zipper in which the slider has no separating finger. Reference will now be made to FIGS. 5–8, in which elements common to the elements shown in FIGS. 1–4 bear the same reference numerals.

Figure 6:
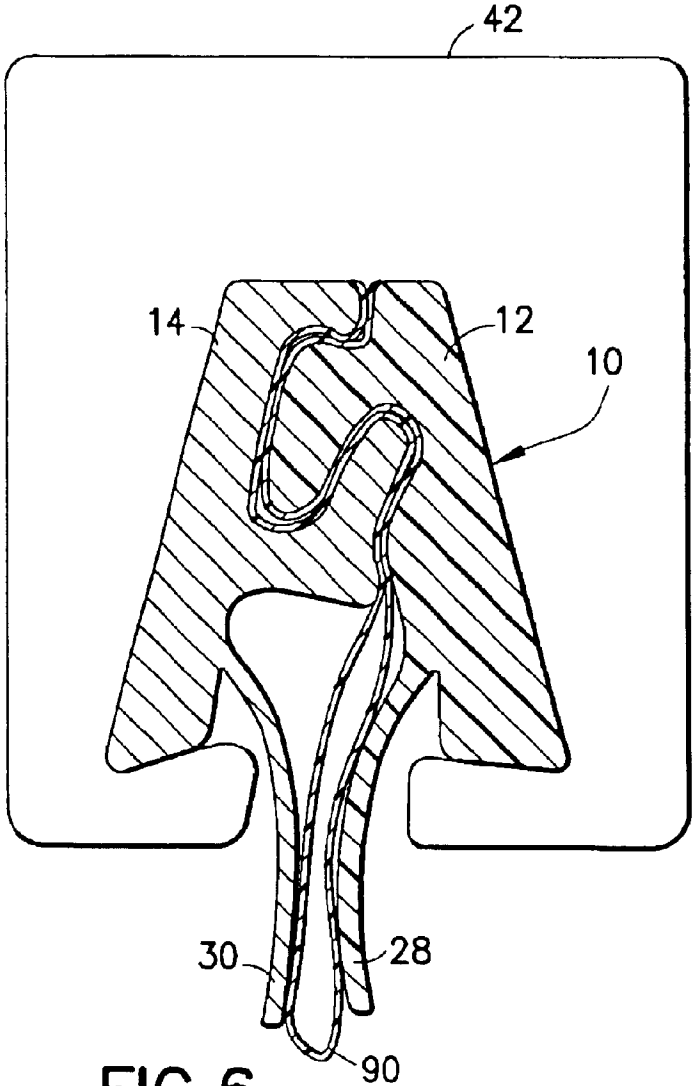
FIG. 6 is a cross-sectional view showing the zipper of FIG. 6 in a closed state with a slider mounted thereon in accordance with the preferred embodiment of the invention.
Figure 5:
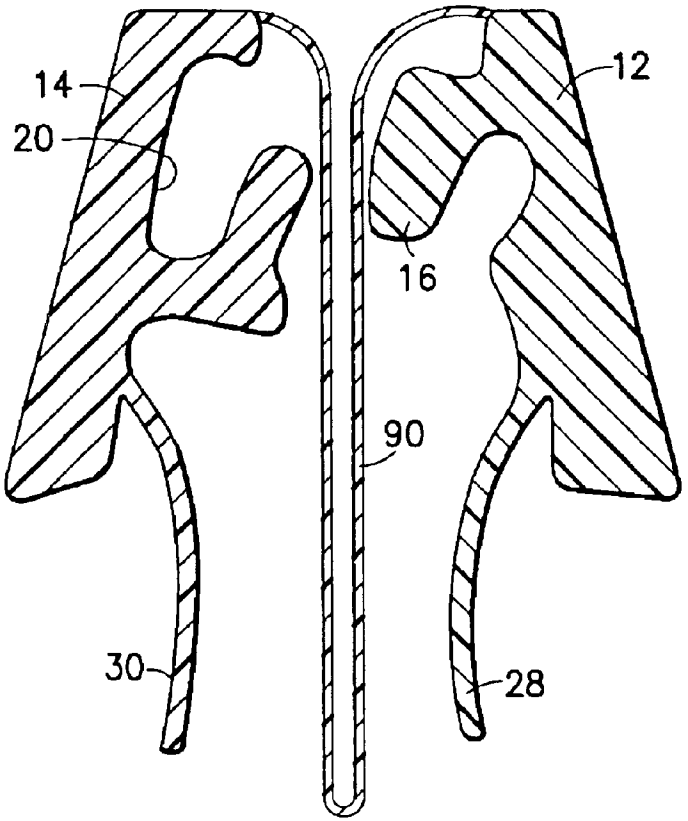
FIG. 5 is a cross-sectional view of a zipper having a membrane connecting the zipper halves in accordance with a first preferred embodiment of the invention. The zipper is shown in an open state.

A first preferred embodiment of the invention is shown in FIGS. 5 and 6, with the zipper depicted in open and closed states respectively. As best seen in FIG. 5, the zipper comprises first and second interlockable profiled structures 12 and 14, flanges 28 and 30 respectively connected to the profiled structures 12 and 14, and a thin pliable membrane 90 connected to the tops of the profiled structures 12 and 14. When the zipper shown in FIG. 5 is incorporated in a package, the walls of the receptacle (not shown) will be heat sealed or adhered to the outer surfaces of the flanges 28 and 30, which are preferably integrally formed with the profiled structures 12 and 14 respectively. Preferably, the first profiled structure 12 comprises a male member 16 and the second profiled structure 14 comprises a female member 20 shaped to receive the male member 16 during zipper closure. The junctions between the membrane 90 and the profiled structures 12 and 14 are preferably but not necessarily located at the top of the zipper. When the zipper is open, as shown in FIG. 5, the membrane 90 depends from the tops of the profiled structures.

As seen in FIG. 6, when the zipper is closed, the membrane 90 is folded and captured between the interlocked profiled structures 12 and 14, the folded membrane occupying the interstice therebetween. After the membrane is sliced open, the membrane remnants captured between the reclosed zipper halves will form a liquid-tight seal along the length of the reclosed zipper. The membrane has sufficient pliancy to conform to the opposing shapes of the interlocked profiled structures 12 and 14. Also, the membrane is of a gauge thin enough that two layers of the membrane, when captured in the interstice between the profiled structures, will act as a liquid-tight seal.

The zipper shown in FIG. 5 can be installed in the mouth of a receptacle (not shown) made of thermoplastic film in a conventional manner. The receptacle comprises front and rear walls (not shown in FIG. 5) heat sealed or adhered to flanges 28 and 30 respectively. The zipper further comprises first and second stomped portions (not shown) at opposing ends, by means of which the zipper halves are secured together. The stomped portions are also shaped to provide end stops for limiting the travel of the slider at either end of the zipper. In accordance with the preferred embodiments of the invention, one edge of the membrane is blended into the first stomped portion and the other edge of the membrane is blended into the second stomped portion, thereby sealing the membrane to the zipper at the ends.

In the embodiment shown in FIGS. 5 and 6, the membrane 90 must be sliced open in order to provide the consumer with access to the contents of the package. Thus the membrane 90 provides evidence of tampering or pilfering to the consumer in the event that the membrane is sliced before the package is purchased. After the membrane 90 is sliced open, the separated remnants of the membrane will form a liquid-tight seal when captured in the interstice between the profiled structures 12 and 14.

Figure 7:
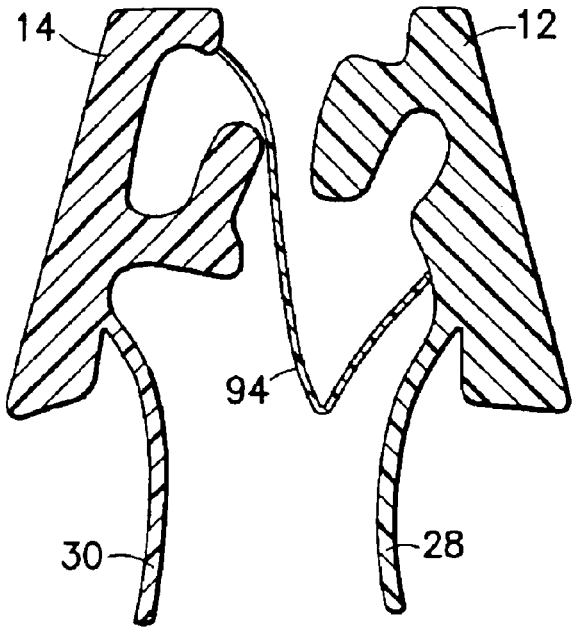
FIG. 7 is a cross-sectional view of a zipper having a membrane connecting the zipper halves in accordance with a second preferred embodiment of the invention. The zipper is shown in an open state.

A second preferred embodiment, in which a membrane 94 also serves as a tamper-evident feature, is depicted in FIG. 7. This embodiment differs from the embodiment of FIG. 5 in that one edge of the membrane 94 is connected to one of the profiled structures (e.g., female profiled structure 14) on the consumer side of the zipper and the other edge of the membrane 94 is connected to the other profiled structure (e.g., the male profiled structure 12) on the product side of the zipper. In this embodiment, the membrane trapped in the interstice between the interlocked profiled structures 12 and 14 need not be folded. The membrane 94 forms a tamper-evident hermetic seal in the unopened package. When the seal is broken, the depending remnant of the torn membrane 94 will again be captured in the interstice between the profiled structures. The membrane 94 should have a gauge thin enough that the captured remnant forms a liquid-tight seal when captured in the interstice between the profiled structures.

Figure 8:
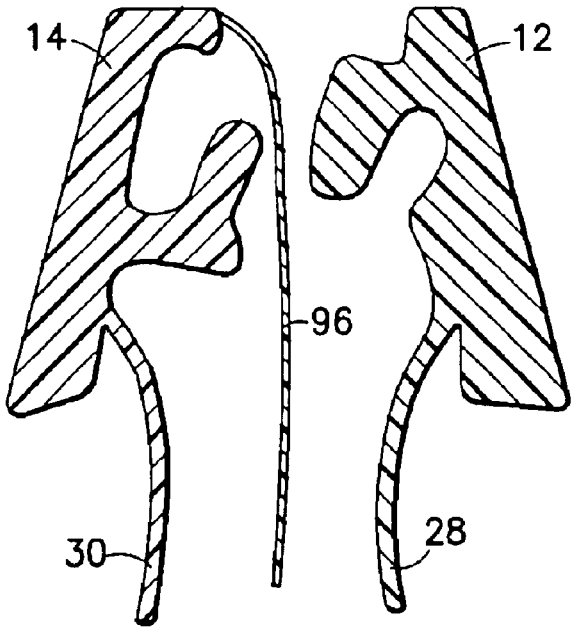
FIG. 8 is a cross-sectional view of a zipper having a gasket depending from one zipper half in accordance with a third preferred embodiment of the invention. The zipper is shown in an open state.

In accordance with a third preferred embodiment depicted in FIG. 8, a sealing gasket in the form of a thin membrane 96 of plastic material is connected to the top of one of the profiled structures, e.g., the female profiled structure 14. The membrane 96 has a gauge thin enough that it fits in the interstice formed by the interlocked profiled structures 12 and 14, yet acts as a liquid-tight seal. In this case, the membrane 96 does not serve as a tamper-evident feature.

For each of the preferred embodiments depicted in FIGS. 7 and 8, the membrane (94 or 96) may be in the form of a thin strip of extruded, cast or scived plastic substantially thinner than the zipper flanges 28 and 30, and may also be substantially thinner than the material of the walls of the receptacle. One aim is to assure that when the zipper is closed, a thoroughly fluid-tight relationship is attained throughout the length of the zipper, with which the membrane should be coextensive. In the embodiment shown in FIGS. 7 and 8, wherein the membrane is folded, it may be desirable to decrease to thickness of the membrane to less than 1 mil.

While the membranes 90, 94, and 96 of the preferred embodiments may be extruded integrally with the profiled structures 12 and 14 of the zipper, the membrane may also be separately formed and then permanently attached to the profiled structures by means of heat sealing or adhesive along opposing margins of the membrane.

Preferably, the membrane in each case has a length about the same as the length of the zipper so that the opposite ends of the membrane are secured, together with the opposite ends of the zipper profile strips, in the side seams of the bag.

In addition, although the interlockable profiled structures can be fused directly to the walls of the packaging material, this is not necessary to practice of the present invention. For example, the interlockable profiled structures could be attached to the wall panels of the package or bag by means of intermediate thermoplastic bonding strips or by means of adhesive.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" includes bags, pouches, and any other type of packaging in which a flexible plastic zipper can be incorporated.

What is claimed is:

1. A package comprising:

a receptacle having a mouth at an upper end;

a plastic zipper attached to said mouth, wherein said zipper comprises first and second profiled zipper strips, said first profiled zipper strip comprising a first base and first and second projections connected to said first base and separated by a groove, and said second profiled zipper strip comprising a second base and a third projection connected to said second base, said third projection having a profile that is complementary to a profile of said groove, said third projection being inserted in said groove with an interstice therebetween;

a slider mounted to said zipper and in contact with said first and second bases, said slider having no separating finger for prying said third projection out of said groove during slider travel along said zipper; and a membrane comprising a first portion connected to said first profiled zipper strip, a second portion connected to said second profiled zipper strip and a third portion that is disposed in said interstice and wherein the connection of said first portion of said membrane to said first profiled zipper strip is located on said first projection and the connection of said second portion said membrane to said second profiled zipper strip is located on said second base.

2. The package as recited in claim 1, wherein said membrane further comprises a fourth portion that is disposed in said interstice, said third and fourth portions of said membrane being in contact with each other.

3. The package as recited in claim 2, wherein said membrane further comprises a fifth portion that connects said third portion to said fourth portion, said fifth portion being disposed in an interior volume defined by said receptacle and said closed zipper.

4. The package as recited in claim 1, wherein the connection of said second portion of said membrane to said second base is disposed at an elevation above said third projection.

5. The package as recited in claim 1, wherein the connection of said second portion of said membrane to said second base is disposed at an elevation below said third projection.

* * * * *